United States Patent [19]

Koga et al.

[11] Patent Number: 4,995,562

[45] Date of Patent: Feb. 26, 1991

[54] DEVICE FOR DRAWING A YARN IN A SLIT

[75] Inventors: Toshiaki Koga; Yasunori Hatakeyama, both of Shiga, Japan

[73] Assignee: Murata Kikai Kabushiki Kaisha, Kyoto, Japan

[21] Appl. No.: 402,222

[22] Filed: Sep. 1, 1989

[30] Foreign Application Priority Data

Sep. 2, 1988 [JP] Japan ..... 63-115029[U]

[51] Int. Cl.[5] ..... B65H 54/00

[52] U.S. Cl. ..... 242/35.6 DE; 242/01800 R

[58] Field of Search ..... 242/35.6 E, 35.6 R, 242/35.5 R, 18 R

[56] References Cited

U.S. PATENT DOCUMENTS 4,760,969 8/1988 Otoshima et al. ..... 242/18 R

*Primary Examiner*—Stanley N. Gilreath

*Attorney, Agent, or Firm*—Spensley, Horn, Jubas & Lubitz

[57] ABSTRACT

A device for drawing a yarn in a slit in a package. A ring body rotates while contacting the end of a bobbin. A capture device provided on the ring body includes a pawl member. The fore end of the pawl member crosses a slit in the bobbin and extends to a portion in the vicinity of the peripheral surface of the bobbin. The ring body is rotated with the yarn from the nip point and the yarn from the slit engaged with the outer periphery thereof. The pawl member is engaged with only the yarn from the slit, due to the difference in position between the nip point and the slit. The yarn from the slit is guided by the pawl member to a capture device, where the yarn is held. The yarn positioned in the slit can be removed by the rotation of the ring body or the movement of the ring body away from the bobbin.

14 Claims, 6 Drawing Sheets

DEVICE FOR DRAWING A YARN IN A SLIT

BACKGROUND OF THE INVENTION

1. Field of the Invention

The present invention relates to a bunch-winding releasing device for a package of the type which is formed by inserting the beginning end of a yarn into a slit formed in the end of a bobbin, bunch-winding the yarn and winding the yarn through a nip. The present invention further relates to a bunch-winding releasing device for drawing a yarn in a slit in which the yarn is removed from the slit when the bunch winding is released and yarn from a nip point and yarn from the slit are simultaneously drawn.

2. Description of Related Art

In a winding machine for tire cords such as polyester or nylon, a package which winds a continuously spun yarn to form a full winding is sent to the desired succeeding step or shipped as the product.

As shown in FIGS. 19 and 20, in such a package the beginning end of yarn is first bunch wound at 1 on the end of a bobbin B. The yarn is then ordinarily wound on the bobbin B to form a package P. The yarn is then bar-wound at 2 to a predetermined length about the outer periphery of the package, and is then shipped as the product. The yarn end of the bar-wound portion 2 is shown at reference character 3.

The bunch winding 1 is applied to the bobbin B by forming a slit in a peripheral direction of the bobbin B, engaging the beginning end of the yarn in the slit, winding the yarn about the end of the bobbin B, applying the bunch winding 1 thereto, and thereafter effecting ordinary winding. It is sometimes desirable to remove the beginning end of the bunch wound yarn, in order to join the beginning end of yarn with yarn on another package. However, the beginning end of yarn cannot be easily removed since the beginning end of the yarn is positioned at the lowermost or innermost layer of the bunch wound yarn.

In view of the foregoing, the present applicant has proposed a device for releasing a bunch wound yarn to draw the beginning end of yarn thereof (see Japanese Patent Application No. 91020/1987, opened for public inspection under the Provisional Patent Publication No. 63-258378 on Oct. 25, 1988, entitled "Device for Drawing a Bunch Wound Yarn").

The device disclosed in the aforesaid Japanese Patent Application is described with reference to FIGS. 14 through 17. Additionally, an example of apparatus which can perform several functions described below (in the background of the invention section), e.g., movement between stations ST1, ST2 and ST3, operating a roller 4 and operating a roller 5, is shown in U.S. Pat. No. 4,760,969 to Otoshima, et al. and assigned to the assignee of the present invention (with reference to conveyor 1, roller 58 and roller 101, respectively of the Otoshima, et al. patent).

In a first stage (designated ST1), a bunch wind 1 is prepared for release by a feed roller 4, as shown in FIGS. 14 and 15. The bunch wind 1 is moved to a second stage (designated ST2), in which the bunch wind prepared for release is released by a loosing roller 5, as shown in FIGS. 16 and 17.

The operation of the feed roller 4 for preparing the release of the bunch winding is described with reference to FIGS. 14 and 15.

A yarn bunch is wound at 1 on a bobbin B1 of the package P1. The yarn has its nip point N located at the outermost layer, as shown in FIG. 14. The beginning end of the yarn in the innermost layer is positioned in a slit S (FIG. 16) formed in the bobbin B1.

A feed roller 4 is operated so that the yarn YN in the bunch winding 1 is moved toward the package P1 in order from the yarn closest to the nip point N. The fore end 4a of the feed roller 4 comes into contact with the peripheral surface of the bobbin B1 between the bunch wind 1 and the nip point N. In that state, when the roller 4 rotates in a direction opposite to the winding direction of the bunch wind 1 (as indicated by the arrow 7 in FIG. 14), the fore end 4a impinges upon the yarn YN extending from the nip point N to the bunch wind 1 and feeds the yarn YN toward the package P1, as shown in FIG. 15.

As a result of the process described above, the yarn of the bunch wind 1 is moved by the feed roller 4 from its outermost yarn toward the nip point N (package side), whereby the beginning end of the yarn positioned in the slit S is exposed to the surface of the bobbin B1.

After the preparation for releasing the bunch wind has been completed, the package P is moved to the second stage ST2, and the bunch wound yarn is removed by the loosing roller 5. This is described with reference to FIGS. 16 and 17.

First, the fore end 5a of the loosing roller 5 comes into contact with the bobbin B2 in the vicinity of the slit S. In that state, the loosing roller 5 is rotated in the winding direction of the bunch wind (as indicated by arrow 8 in FIG. 16).

When the loosing roller 5 rotates as described above, the roller 5 loosens the yarn from the beginning end of the yarn. The bunch wound yarn is sucked into a suction opening 9a within a support body which is inserted into the bobbin B2. The bunch wound yarn is sucked and removed from the bobbin B2.

After the bunch winding has been released as described above, the support body 9 is moved away from the end of the bobbin B2. The yarn sucked into the support body 9 is suitably held so as not to be drawn out, as shown in FIG. 17. The beginning end of the yarn positioned in the slit S may be removed as shown in FIG. 18.

However, if the yarn is firmly positioned in the slit S, then the beginning end of the yarn cannot be removed from the slit S even if the support body 9 is moved. The yarn YN on the side of the nip point as well as the yarn YS on the side of the slit S are drawn between the bobbin B2 and the suction opening 9a of the support body 9, as shown in FIG. 4. Even if a predetermined length of the yarn YN on the side of the nip point is wound on the bobbin B, the yarn YS on the side of the slit S is a hindrance. The support body disclosed in Japanese Patent Application No. 91020/1987 (referenced above) needs to be reciprocated many times until the yarn YS on the side of the slit is removed.

It is an object of the present invention to provide a device for drawing a yarn in a slit in which the yarn on the side of the slit can be easily removed when the yarn is drawn.

SUMMARY OF THE INVENTION

In accordance with the present invention, this and other objectives are achieved by providing a device for drawing a yarn in a slit in a package. The package is of the type formed by engaging the beginning end of a yarn with a slit positioned in the end of a bobbin, bunch winding the yarn and winding the same through a nip. The yarn is removed from the slit when the bunch wound yarn is removed and released from the bobbin end, and when yarn from the nip point and yarn from the slit are simultaneously drawn.

In its preferred embodiment, the present invention comprises a ring body which rotates while contacting the bobbin end. A capture device provided on the ring body includes a pawl member. The fore end of the pawl member crosses the slit and extends to a portion in the vicinity of the peripheral surface of the bobbin.

The ring body is rotated with the yarn from the nip point and the yarn from the slit engaged with the outer periphery thereof. The pawl member is engaged with only the yarn from the slit, due to the difference in position between the nip point and the slit. The yarn from the slit is guided by the pawl member to a capture device, where the yarn is held. The yarn positioned in the slit can be removed by the rotation of the ring body or the movement of the ring body away from the bobbin.

BRIEF DESCRIPTION OF THE DRAWINGS

A detailed description of a preferred embodiment of the invention will be made with reference to the accompanying drawings.

DESCRIPTION OF THE PREFERRED EMBODIMENT

The following detailed description is of the best presently contemplated mode of carrying out the invention. This description is not to be taken in a limiting sense, but is made merely for the purpose of illustrating the general principles of the invention. The scope of the invention is best defined by the appended claims.

Figure 1:
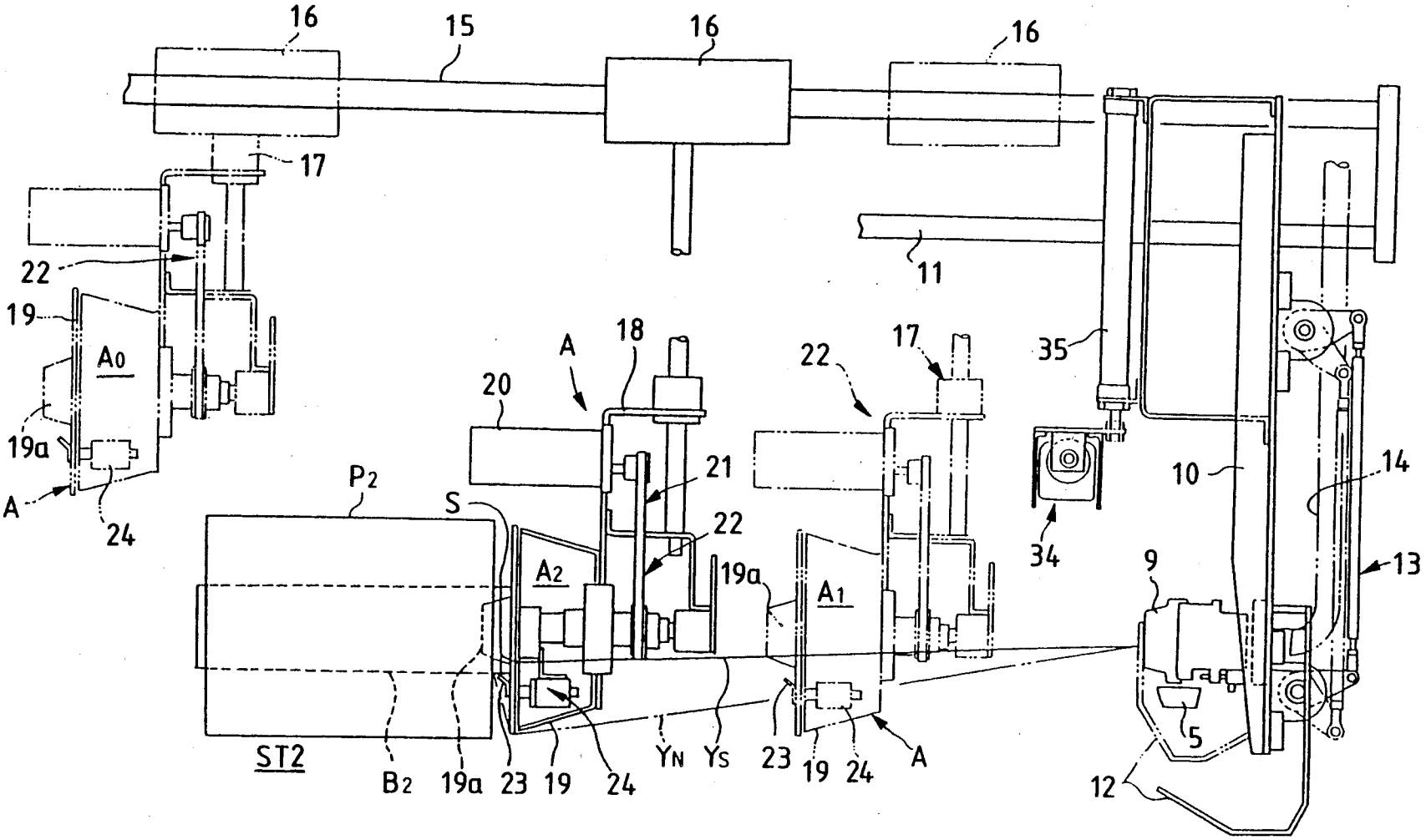
FIG. 1 shows a front view of one embodiment of the present invention.

As illustrated in FIG. 1, a support body 9 provided with a loosing roller 5 is supported on a moving body 10. The moving body 10 is reciprocated in the axial direction of the package P by means of a first feed screw 11. A yarn keep lever 12 for yarn which is sucked by the support body 9 is rotatably provided on the moving body 10. A link mechanism 13 is provided for rotating the yarn keep lever 12 from a position indicated by the solid line to a position indicated by the dash-dotted contour lines. A suction pipe 14 in which the yarn is sucked by the support body 9 is also provided.

As illustrated in FIG. 1, the support body 9 is in the state in which the bunch winding is released (as described in connection with FIGS. 14 to 17), and in which both the yarn YN from the nip point N and the yarn YS from the slit S are drawn.

A drawing device A for removing the beginning end of yarn YS from the slit S of the bobbin B2 is provided. The drawing device A is provided through an elevating device 17 on a moving body 16 reciprocated by a second feed screw 15. The drawing device A is moved by the moving body 16 and the elevating device 17 between a stand-by position $A_o$, an inserting position $A_1$ between the package P2 and the support body 9 and an operating position $A_2$ fitted in the end of the bobbin B2.

The drawing device A includes a support frame 18 supported on the elevating device 17. A ring body 19 is rotatably provided on the support frame 18 and has substantially the same diameter as that of the package P2. A cone portion **19*a* is rotatably provided in the central portion at the extreme end of the ring body 19 and is configured to fit in the end of the bobbin B2. A rotational means 22 includes a motor 20 provided on the support frame 18 and a transmission device 21 to rotate the ring body 19. A capture device 24 is provided on the ring body 19 and has a pawl member 23** for capturing the yarn YS from the slit S.

The capture device 24 is described in more detail with reference to FIGS. 2 and 3.

Figure 2:
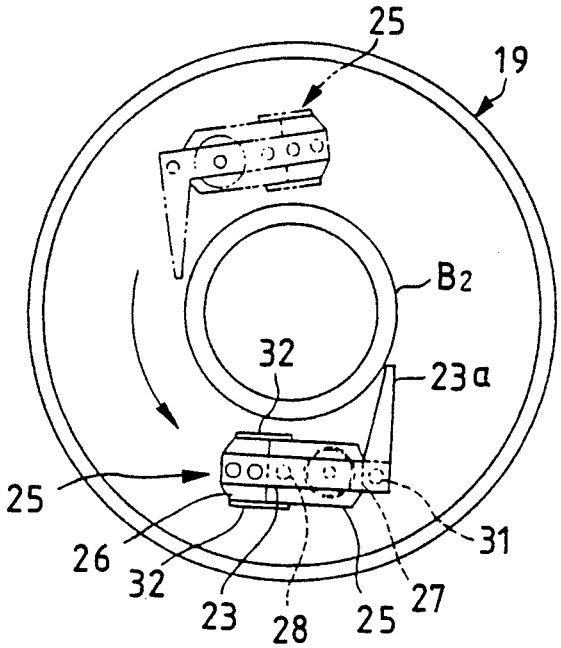
FIG. 2 is a sectional view taken along line II—II of FIG. 1.
Figure 3:
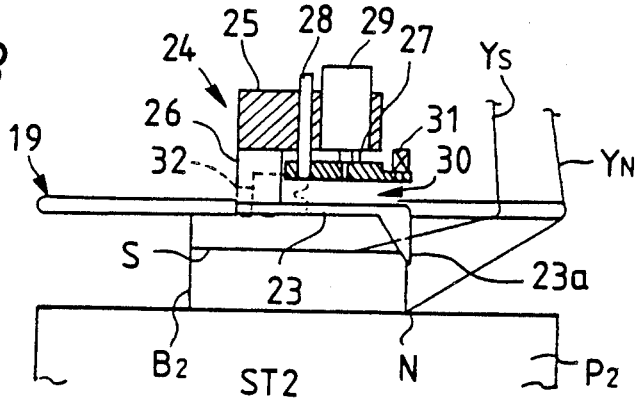
FIG. 3 is a bottom view of FIG. 2.

In FIGS. 2 and 3, a support plate 25 is provided on the surface of the ring body 19 on the side of the bobbin B2, through a spacer 26. A fore end **23*a* of the pawl member 23 is formed so as to cross the slit S of the bobbin B2 and so as to extend to a portion near the peripheral surface of the bobbin B2. A holding plate 27 is arranged between the pawl member 23 and the supporting plate 25. A rod 28 is connected to the holding plate 27, the rod 28 being provided movably on the support plate 25. A cylinder 29 provided on the support plate 25 is connected to the holding plate 27, the holding plate 27 being moved to and away from the pawl member 23. On the holding plate 27 is provided a sensor 31 which detects the presence or absence of the yarn whether or not the yarn is guided to a groove 30 formed between the holding plate 27 and the pawl member 23. Yarn keep plates 32 and 32 are positioned at the rear of the groove 30 and provided on the opposite sides of the pawl member 23**.

In FIG. 1, reference numeral 34 designates a tension roller provided on the moving body 10 through an elevating cylinder 35.

The function of the above-described embodiment is described hereinafter.

Figure 4:
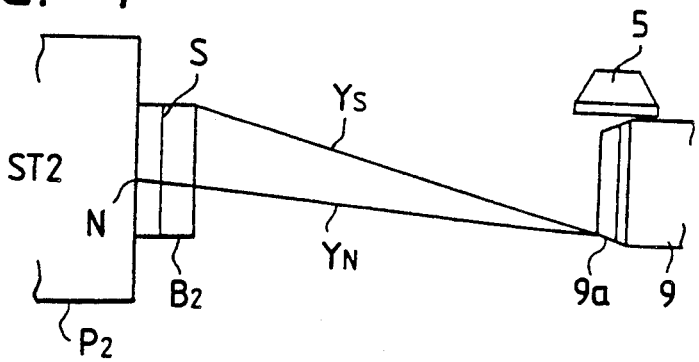
FIG. 4 is a front view showing a state wherein the bunch winding is released.
Figure 5:
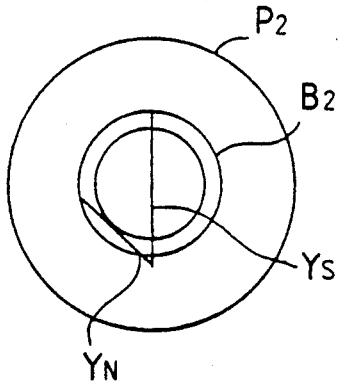
FIG. 5 is a right side view of FIG. 4.
Figure 6:
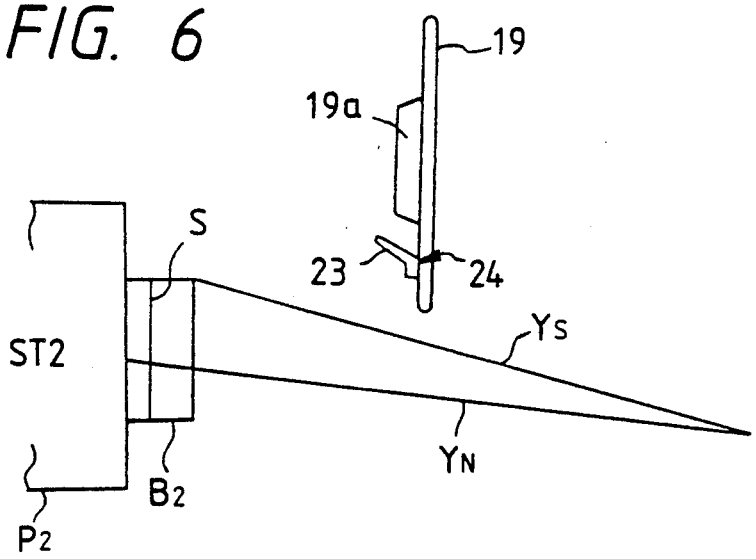
FIGS. 6, 7, 8, 10 and 12 are front views showing how a yarn in a slit is removed in a preferred embodiment of the present invention.
Figure 7:
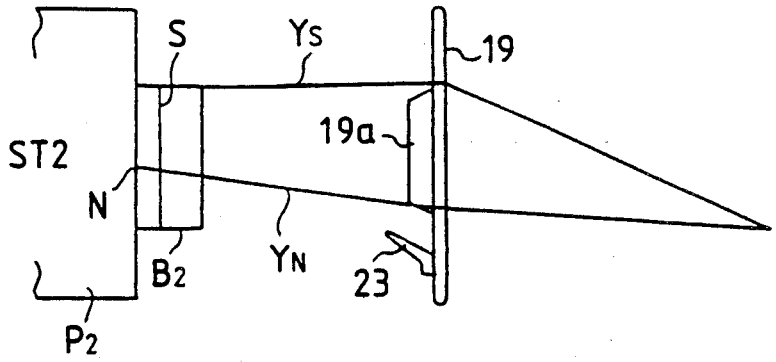

The bunch winding 1 is released as described in connection with FIGS. 14 to 17. The moving body 10 supporting the support body 9 is moved backward to the position shown in FIG. 1. The yarn YN from the nip point N and the yarn YS from the slit S are simultaneously drawn between the bobbin B2 and the support body 9, as shown in FIG. 4. The elevating device 17 is moved by the moving body 16 from the stand-by position $A_o$ to the inserting position $A_1$ shown in FIG. 1. The drawing device A is moved down by the elevating device 17. This state is shown in FIG. 6. The ring body 19 is lowered from the FIG. 6 state until the ring body coincides with the axis of the package P2. The ring body 19 is moved until the cone portion **19*a* is fitted in the bobbin B2, as shown in FIG. 8**.

During the lowering of the ring body 19 and the movement thereof toward the bobbin B2, it is possible that the yarn YS on the slit S side may be positioned on the upper surface of the bobbin B2, as shown in FIGS.

4 and 5. When the ring body 19 as shown in FIG. 6 is moved downward, the yarn YS is positioned below the ring body 19. When the ring body 19 is moved toward the bobbin B2, the yarn YS might become trapped between the cone portion 19*a* and the end of the bobbin B2. Therefore, in the FIG. 6 state, the tension roller 34 shown in FIG. 1 is moved down by the down cylinder 35. The yarn YN from the nip point N and the yarn YS from the slit S are held by the tension roller 34. A predetermined tension is applied to the yarn Y, particularly to the yarn YS from the slit. The yarn YS is thereby prevented from being held between the cone portion 19*a* and the end of the bobbin B2.

Figure 8:
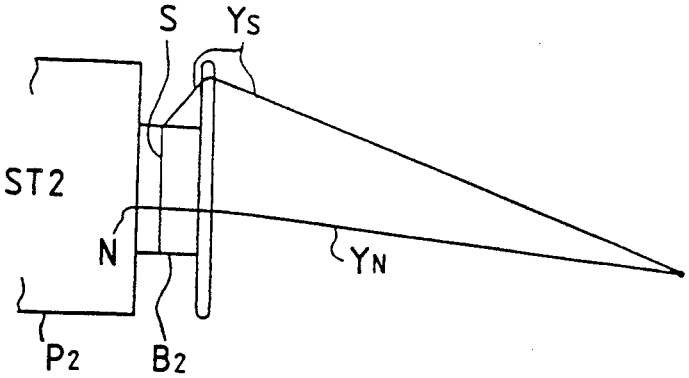
Figure 9:
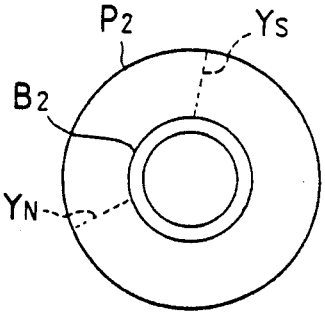
FIGS. 9, 11 and 13 are right side views of FIGS. 8, 10 and 12, respectively.
Figure 10:
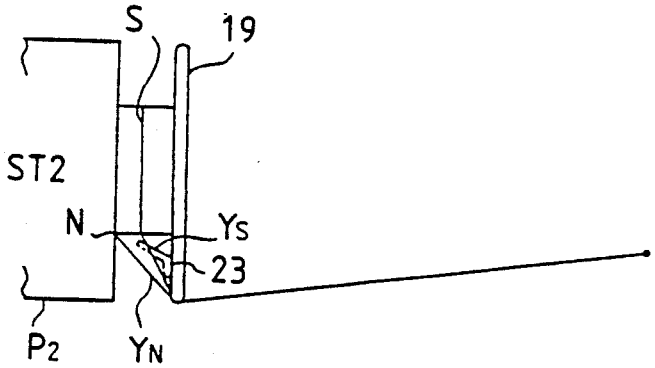
Figure 11:
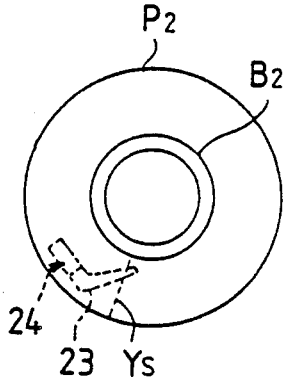
Figure 12:
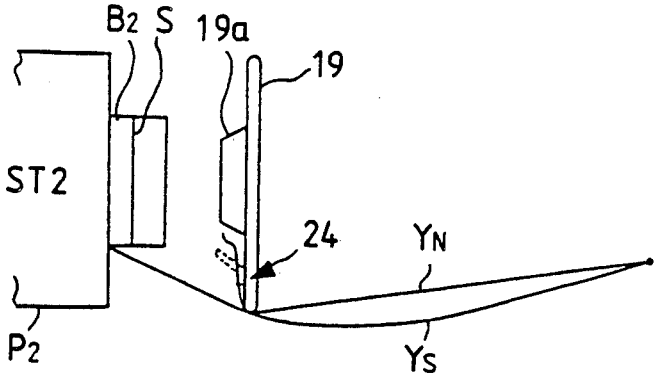
Figure 13:
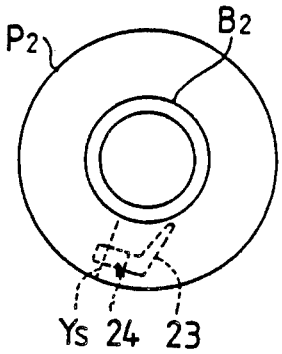
Figure 14:
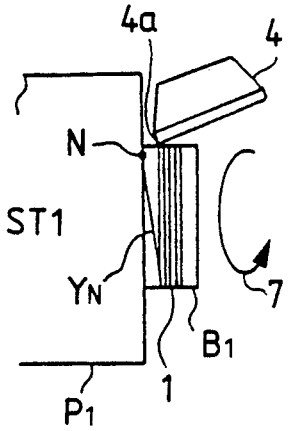
FIGS. 14 through 18 are front views showing a state in which bunch winding is released.
Figure 15:
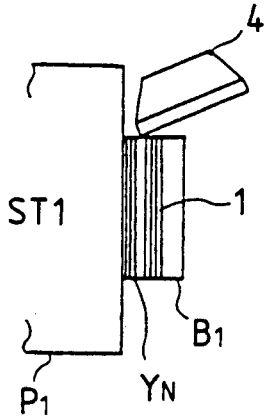
Figure 16:
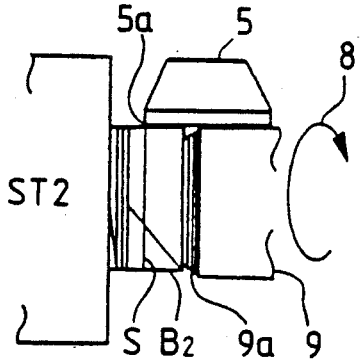
Figure 17:
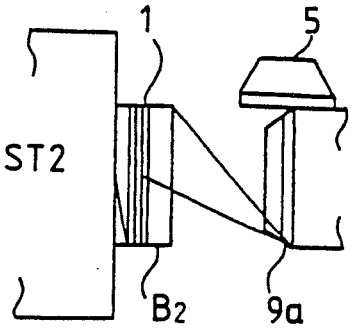
Figure 18:
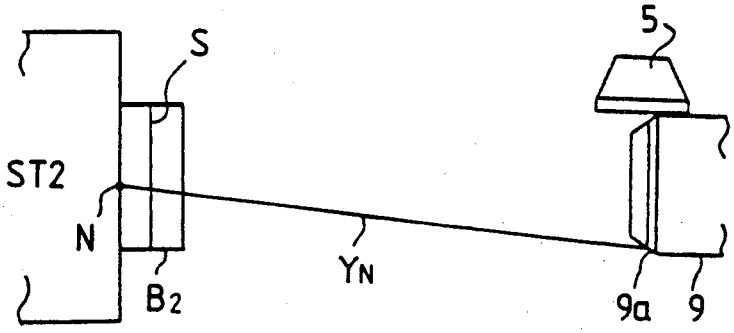
Figure 19:
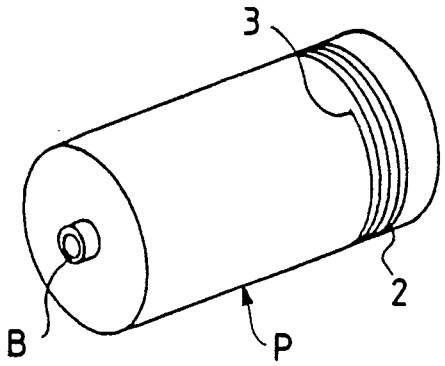
FIG. 19 is a perspective view of a package.
Figure 20:
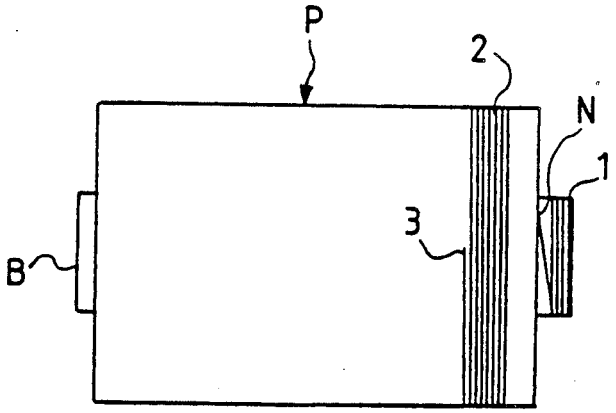
FIG 20 is a plan view of a package.

The cone portion 19*a* of the ring body 19 is then moved until the cone portion is fitted in the bobbin B2, as shown in FIGS. 8 and 9. The ring body 19 is rotated by the rotating means 22. The pawl member 23 of the capture device provided on the ring body 19 comes into engagement with only the yarn YS from the slit S, as shown in FIGS. 10 and 11. The pawl member 23 guides the yarn YS to the groove 30 of the capture device 24. When the yarn YS is detected by the sensor 31, the cylinder 29 is actuated to move the holding plate 27. The yarn YS is thereby captured by the pawl member 23. In this state, when the ring body 19 is further rotated, the beginning end of yarn positioned in the slit S is removed, as shown in FIGS. 12 and 13. Thereafter, the yarn captured by the capture device 24 is released, whereby the yarn YS on the slit side is removed through the suction opening 9*a* of the support body 9.

After the yarn YN from the nip point N has been drawn from the bobbin B, the package P is moved to the subsequent stage for yarn processing.

As will be apparent from the above explanation, the present invention exhibits a number of excellent effects. With reference to the numbered elements of the illustrated preferred embodiment, these effects include the following:

(1) The ring body 19 fitted in the bobbin end is rotatable. The ring body 19 is provided with a capture device 24 having a pawl member 23 of which the fore end 23*a* crosses the slit S and extends to a portion in the vicinity of the peripheral surface of the bobbin. The yarn YS positioned in the slit S can thereby be positively removed.

(2) The yarn YS positioned in the slit S is removed from the peripheral direction thereof, and therefore the yarn can be easily drawn out.

The presently disclosed embodiment is therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A device for removing yarn from a slit in a bobbin having an axis and a bunch winding of yarn thereon, the device comprising:
- release means for releasing the bunch winding of yarn,
- yarn drawing means for drawing the yarn from the slit,
- a ring body having an axis,
- alignment means for aligning the axis of the bobbin and the axis of the ring body,
- positioning means for positioning the ring body substantially adjacent the bobbin,
- rotation means for rotating the ring body,
- a pawl member associated with the ring body for engaging the yarn drawn from the slit, and
- a capture device associated with the pawl member for capturing the yarn engaged by the pawl member 2. A device as in claim 1 further comprising:
- release means for releasing the yarn captured by the capture device, and
- suction means for removing the released yarn through a suction opening of a support body.

3. A device as in claim 1 further comprising:
- means for moving the ring body away from the bobbin.

4. A device as in claim 1 wherein the ring body includes a cone portion, and further comprising:
- means for inserting the cone portion of the ring body in the bobbin,
- tension means for applying tension to the yarn drawn from the slit to thereby prevent the yarn from being held between the cone portion and the end of the bobbin.

5. A device as in claim 1 wherein the pawl member includes a fore end configured to extend beyond the slit of the bobbin and adjacent the peripheral surface of the bobbin when the ring body is positioned substantially adjacent the bobbin.

6. A device as in claim 1 further comprising:
- a supporting plate associated with the ring body, and
- means for holding the yarn between the pawl member and the supporting plate.

7. A device as in claim 7 further comprising:
- detection means for detecting yarn held between the pawl member and the supporting plate.

8. A method of removing yarn from a slit in a bobbin having a bunch winding of yarn thereon, the method comprising the steps of:
- releasing the bunch winding of yarn,
- drawing the yarn from the slit in the bobbin,
- aligning the axis of a bobbin and the axis of a ring body,
- positioning the ring body substantially adjacent the bobbin,
- rotating the ring body,
- engaging the yarn drawn from the slit in the bobbin with a pawl member associated with the ring body,
- capturing the yarn drawn from the slit in the bobbin by a capture device associated with the pawl member, and
- extracting the yarn from the slit.

9. A method as in claim 8 further comprising the steps of:
- releasing the yarn captured by the capture device, and
- removing the released yarn through a suction opening of a support body.

10. A method as in claim 8 wherein the step of extracting the yarn from the slit further comprises the step of further rotating the ring body.

11. A method as in claim 8 wherein the step of extracting the yarn from the slit further comprises the step of moving the ring body away from the bobbin.

12. A method as in claim 8 wherein the ring body includes a cone portion, and further comprising the steps of:
- inserting the cone portion in the bobbin, and
- applying tension to the yarn drawn from the slit to thereby prevent the yarn from being held between the cone portion and the bobbin.

13. A device for removing yarn from a slit in a bobbin having a yarn bunch winding thereon, the device comprising:

release means for releasing the bunch winding of yarn, wherein upon releasing, yarn is extended from the bobbin slit;

a pawl member arranged to engage the yarn extending from the slit; and means for moving the pawl member with respect to the slit and to release from the slit the yarn extended from the slit.

14. A device as claimed in claim 13, further comprising a capture device associated with the pawl member for capturing the yarn engaged by the pawl member.

* * * * *